United States Patent [19]

Fisch et al.

[11] Patent Number: 4,949,085

[45] Date of Patent: Aug. 14, 1990

[54] PRIORITIZATION OF STORED MESSAGES IN A DIGITAL VOICE PAGING RECEIVER

[75] Inventors: Kenneth D. Fisch, Delray Beach; Walter L. Davis, Coral Springs, both of Fla.

[73] Assignee: Motorola, Inc., Schaumburg, Ill.

[21] Appl. No.: 334,734

[22] Filed: Apr. 7, 1989

Related U.S. Application Data

[63] Continuation of Ser. No. 68,683, Jun. 30, 1987, abandoned.

[51] Int. Cl.[5] ..... G08B 5/22

[52] U.S. Cl. ..... 340/825.440; 340/825.48; 340/311.1

[58] Field of Search ..... 340/825.44, 825.48, 340/311.1, 539; 455/31, 38; 379/56, 57

[56] References Cited

U.S. PATENT DOCUMENTS

| | | | |
|---|---|---|---|
| 4,412,217 | 10/1983 | Willard et al. | 340/825.44 |
| 4,477,807 | 10/1984 | Nakajima et al. | 340/825.44 |
| 4,477,808 | 10/1984 | Ichikawa | 340/825.44 |
| 4,479,124 | 10/1984 | Rodriguey et al. | 340/825.44 |
| 4,521,776 | 6/1985 | Smoot et al. | 340/825.44 |
| 4,682,148 | 7/1987 | Ichikawa et al. | 340/311.1 |
| 4,701,943 | 10/1987 | Davis et al. | 379/88 X |

FOREIGN PATENT DOCUMENTS 2149164 6/1985 United Kingdom .

*Primary Examiner*—Donald J. Yusko
*Assistant Examiner*—Edwin C. Holloway, III
*Attorney, Agent, or Firm*—William E. Zitelli; Vincent B. Ingrassia

[57] ABSTRACT

A device and method are disclosed for saving stored messages in a digital stored voice paging receiver. The digital stored voice paging receiver includes a plurality of message slots, each slot capable of storing a digitized voice message. A status value associated with a message slot is representative of the status of the message in the slot. A first embodiment of the method stores messages in the message slots by chronologically replacing older messages. A second embodiment of the method orders the stored messages in a predetermined priority. A stored message is replaced by an incoming message when the incoming message priority status is greater than the stored message priority status.

7 Claims, 9 Drawing Sheets

PRIORITIZATION OF STORED MESSAGES IN A DIGITAL VOICE PAGING RECEIVER

This is a continuation of application Ser. No. 07/068,683, filed Jun. 30, 1987, now abandoned.

BACKGROUND OF THE INVENTION

1. Field of the Invention

This invention relates to paging receivers, and more particularly, to a paging receiver for receiving information including analog voice messages, digitizing the analog voice messages and storing the voice messages in a memory for playback.

2. Background of the Invention

Communications systems in general and paging systems in particular using transmitted call signals have attained widespread use for calling selected receivers to transmit information from a base station transmitter to the receivers. Modern paging systems and paging receivers in particular have achieved multifunction capabilities through the use of microcomputers which allow the paging receiver to respond to information having various combinations of tone, tone and voice, or data messages. This information is transmitted using any number of paging coding schemes and message formats.

In the operation of such paging receivers, important factors involved in their successful operation is the portability of the receiver, the limited energy available for the receiver, the limited availability of the radio spectrum, the fast response time required in today's active society, and the number of paging receivers included in the paging system. In such paging receivers, in order that the drain on the battery may be minimized, the paging receiver is systematically turned off and turned on to maximize the length of time energy is available from the battery (battery saving). The limited energy in which the paging receiver must operate constrains the type of electronic circuitry available for a paging receiver.

A typical voice type paging system uses analog voice channels for the transmission and reception of voice messages. While certain types of paging systems use binary signalling formats, transmission in an analog form remains the most common technique for voice signals. Prior art paging receivers that receive analog representation of voice signals are limited in several features that would be highly desirable. These include the ability to store a voice message in a reasonable size memory for recall at a later time and the use of digital modulation techniques to store and reconstruct voice messages in the paging receiver. Digital processing of voice messages is, in general, qualitatively superior to analog processing. This is a result of the fact that once the voice message is in a digitally-represented form, it is not subject to the type of signal degradation that occurs in analog processing. Thus, it is beneficial to represent the voice message in digital form rather than as a voltage subject to the type of distortion inherent in analog processing techniques.

Problems with prior art analog voice paging receivers include the ability to store a plurality of voice messages, prioritize the voice messages, and selectively recall a voice message. Prior art analog voice paging receivers have typically stored the voice information on conventional analog magnetic tapes (e.g. U.S. Pat. No. 4,356,519). While such voice type paging receivers are available, they are typically commercially inoperative.

Some of the reasons are the cost of the electronic components, the low battery life from the high drain of current required by the tape mechanism, and the difficulty in operating in a battery saving environment. Additionally, if a sequence of messages is stored on the tape, the recall of a single message is hampered by the inability of the analog magnetic tape to randomly select a single message.

A particular problem with stored voice paging receivers is the situation in which the paging microcomputer's memory is full and a message received or previously stored is lost because of the lack of memory available to store the message. Therefore, it would be highly desirable to have a stored voice paging receiver which prioritizes the messages in which higher priority messages are saved at the destruction of lower priority messages.

SUMMARY OF THE INVENTION

It is therefore an object of the present invention to overcome the problems of the prior art analog voice paging receivers by providing a digitized stored voice paging receiver.

It is another object of the present invention to provide a digital stored voice paging receiver capable of receiving, digitizing, prioritizing, and storing a plurality of voice messages for later recall.

It is another object of the present invention to provide a digitized stored voice paging receiver that selectively protects specified stored voice messages at the expense of unprotected stored voice messages.

These as well as other objects and advantageous features of the present invention will be apparent and in part pointed out here after.

In general, a communication receiver, such as a paging receiver for receiving analog information having at least one voice message, includes a receiving means, a decoding means, a memory means, and a conversion means. The receiving and decoding means receives information signals, including at least one voice message and control signals, decodes the information signals for selectively enabling a receiver correlating to the received control information, and decodes the information to recover the voice message. The conversion means converts the analog voice information to digital information, the digital information being representative of a replica of the analog voice message. The digital information is then stored according to a predetermined priority scheme in a memory of the selected receiver. In response to user generated inputs, the paging receiver selects a digitized voice message stored in the memory of the receiver, reconverts the digitized voice to an analog signal, and produces audible voice information from the analog signal representative of the original analog voice message.

In particular, the paging receiver system and method of the present invention stores digitized voice messages according to a predetermined priority scheme. Specifically, a stored message is associated with a status value, the status value indicative of importance to the paging receiver user. The method scans previously stored messages and selectively stores new messages according to the priority scheme, destroying less important messages in sake of saving more important messages.

CROSS-REFERENCE TO RELATED PATENT APPLICATIONS

The present patent application is one of a group of copending patent applications which concern the same overall paging receiver configuration but which individually claim different inventive concepts embodied in such overall paging receiver configuration. These related patent applications were filed on the same date, namely, June 30, 1987, are specifically incorporated by reference herein, and are more particularly described as follows:

(1) Application Ser. No. 07/323,056 entitled "Digitized Stored Voice Paging Receiver", the inventors being Bennett et al., assigned to the assignee of the present application; and (2) Application Ser. No. 07/068,073 entitled "Digitized Stored Voice Paging Receiver Having a Single Input User Control", the inventors being Fisch et al., asigned to the assignee of the present application.

BRIEF DESCRIPTION OF THE DRAWINGS

For the purpose of illustrating the invention, there is shown in the drawings an embodiment which is presently preferred, it being understood, however, that the invention is not limited to the precise arrangement and instrumentality shown.

DETAILED DESCRIPTION OF THE PREFERRED EMBODIMENT

In order to best illustrate the utility of the present invention, it is described in conjunction with a communication receiver, such as a paging receiver, capable of receiving, decoding, and storing transmitted analog or voice information. While the present invention is described hereinafter with particular reference to a paging receiver, it is to be understood at the outset of the description which follows it is contemplated that the apparatus and methods, in accordance with the present invention, may be used with numerous other communication receiving systems.

The paging receiver system described herein is associated with a paging system having a base station terminal, responds to coded data information from the base station terminal, and in turn, decodes, digitizes, stores, and provides analog or voice messages to a user during operation. With reference to the drawings in general, there is illustrated a paging receiver 10 and a method for receiving, decoding, digitizing, and storing voice messages transmitted from the base station terminal. A detailed description of a paging receiver capable of performing the operations as discussed with reference to FIGS. 2–9 is disclosed in copending application Ser. No. 323,056, entitled "Digitized Stored Voice Paging Receiver", invented by Bennett, et al., filed even date herewith, the disclosure of which is hereby incorporated by reference.

Figure 1:
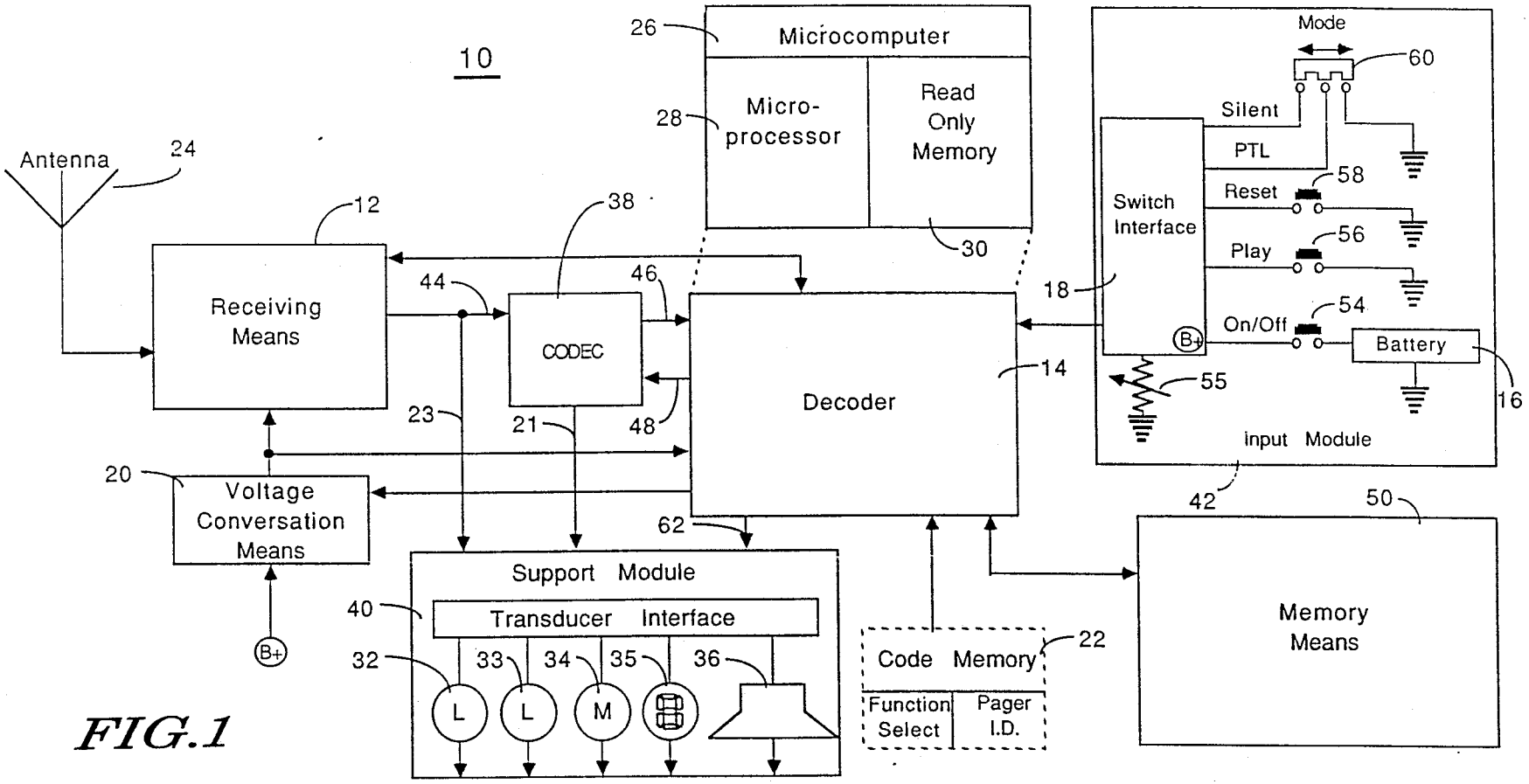
FIG. 1 is a schematic diagram of a digitized stored voice paging receiver embodying the present invention.

Briefly, FIG. 1 shows a functional block diagram of a paging receiver of the present invention. The paging receiver 10 of the present invention includes a receiving means 12, a decoding means 14, a memory means 50, a support module 40, an input switch module 42, a voltage conversion means 20, and a converting means 38. An antenna 24 receives paging information including receiver control signals and analog information including speech signals representative of a voice message. The antenna 24 is coupled to receiving means 12 that is subject to the control of decoder 14. The decoder 14 not only controls receiving means 12, but may also operate receiving means 12 on an intermittent basis to extend the life of battery 16 through voltage conversion means 20. The receiving means 12 detects the presence of electromagnetic energy representing the paging information and applies the information to the converting means such as coder-decoder 38. The coder-decoder 38 converts the received analog signals, such as real time audio speech signals, to a stream of binary bits and reconverts stored binary bits to a replica of the original received analog signals, such as synthesized audio speech signals.

In the illustrated embodiment, the coder-decoder 38 (hereinafter referred to as CODEC) provides for the digital-to-analog and analog-to-digital conversion of speech signals. The CODEC 38, such as an adaptive delta modulator, can convert or encode an audio input signal to a digital data stream for storage and reconvert or decode a digital data stream to reconstruct an audio signal. In particular, the CODEC 38 monitors the real time audio signal on line 44 and compares it to a past value that it has reconstructed and generates a digital bit (sign) that indicates whether the reconstructed signal's voltage level is higher or lower than the present input value. The CODEC 38 then tries to adapt the reconstructed signal voltage to mirror the present value at the audio input by varying or modulating a current. The current charges or discharges a capacitor (not shown) which changes the reconstructed signal's voltage. The digital output on line 46 is the sign bit which indicates whether the reconstructed signal is behind the input or lower in voltage (logic "0") or ahead of the input or higher in voltage (logic "1"). The CODEC's digital output is stored in memory 50 and retrieved on line 48 to reconstruct a synthesized audio signal on line 21, thus closely replicating the real time audio signal in both amplitude and frequency. One example of such a coder-decoder is disclosed by N. S. Jayant in the publication "Adaptive Delta Modulation with a One-Bit Memory", Bell System Technical Journal, Vol. 49, No. 2, March 1970. The CODEC 38 is designed to operate at sampling rates (bit or clock rates) of 16 KHz, 25 KHz, and 33 KHz. The obvious implication of the three rates is that for slower clock rates, longer messages can be stored in a fixed amount of memory at the expense of a lower signal to noise (S/N) ratio. For example, at a 100 mV P-P 1 KHz signal at the input, the signal to noise degradation is 11 dB at 33 KHz, 14 dB at 25 KHz, and 23 dB at 16 KHz.

To conserve power, most of the CODEC 38 is turned off when there are no read/write operations to the memory. The output buffers and control logic are always on since it may be necessary to monitor the channel or provide a BEEP tone when there are no messages stored. Keeping the buffers and control logic on also eliminates the need for additional current source controls to handle the switching of an additional current source.

The receiving means 12 is further coupled by line 23 to a support module 40. Operating in response to decoder 14, the real time audio signal on line 23 is applied to support module 40 which supplies analog or digital signals to one of annunciation transducers 32–36. In particular, decoder 14 controls support module 40 to apply either the real time audio signal on line 23 or the synthesized audio signal on line 21 to speaker 36. In practice, lines 21 and 23 may be a single line.

Decoder 14 is associated with memory means 50 which serves to include information for decoding the received information and for storing information received from CODEC 38. The CODEC 38 provides the analog-to-digital conversion of speech signals on line 46 which are stored in memory 50 as digital voice messages. A plurality of digital voice messages can be stored in memory 50 along with the status of each voice message. For example, a voice message may have either a read or unread status. The decoder 14 also functions to alert the paging user, store, recall, and playback voice messages.

The paging receiving of FIG. 1 has the capability of storing selective call voice messages for providing them to support module 40 according to the state of a plurality of inputs, such as the state of the control switches of input module 42. A switch interface 18 provides input capability for control switches 54–60. Illustratively, control switch 54 is an on/off switch for controlling poWer from battery 16. Control input 55 is a volume control for speaker 36. Control switch 56 is a play switch for playing back voice messages previously digitized and stored in memory 50. Control switch 58 is a reset switch to reset the paging receiver system and monitor the real time audio signal. Control switch 60 is a mode switch for operating the decoder in one of three modes. These modes are the silent, push to listen (PTL), and normal modes.

Considering FIG. 1 in somewhat further detail, the battery 16 is shown connected to decoder 14 through a switch interface 18. Battery 16 provides poWer to decoder 14 through a voltage conservation means 20, such as a DC to DC converter. Decoder 14 is additionally connected to a code memory 22 further including regions designated function select and pager ID. The enclosure of code memory 22 with a broken line indicates a possibility that such a device can be made removable and therefore separable from the rest of the system. Another output 62 of decoder 14 is coupled to support module 40 to provide the necessary controls for generating alerts on one of alert transducers 32–36. The alert transducers may take the form of an illumination means 32 and 33, such as an LED, a vibration motor 34, a visible display counter 35, and an audio speaker 36. Output 62 also controls whether real time audio signals on line 23 from receiving means 12 or synthesized audio signals on line 21 from CODEC 38 are applied to audio speaker 36.

It is to be understood that decoder 14 may function entirely by a microsequencer or microcomputer 26. Microcomputer 26 is shown to be further comprised of a microprocessor 28 and a read only memory (ROM) 30. The ROM 30 includes the necessary instructions to operate microprocessor 28 to perform the functions as described in FIGS. 2–9.

The operation of the paging receiver shown in FIG. 1 is such that the receiving means 12 is capable of receiving messages in any of several message formats through an antenna 24. The decoder 14 responds to the receive signals to analyze the data and select one of several decoding schemes for appropriately decoding the incoming information received by receiving means 12. As with all paging devices, the resulting decoded signal is tested for comparison with a designated pager address contained in code memory 22. On detecting correspondence between the received and decoded signal and the address in code memory 22, the decoder instructs the CODEC 38 to digitize the real time analog signal and provide the digitized signal to the decoder 14 for storage in one of a plurality of message locations or slots in memory 50. An alert output signal is produced by the decoder 14 to generate an alert indicating to the pager user that a message has been received and stored. In particular, the alert output signal from the decoder 14 is supplied to support module 40 to produce a signal on one of a plurality of transducers 32–36 indicative of the receipt of the message. Specifically, upon the receipt of a message, an unread message indicator 32 is activated and an unread message counter 35 is incremented. Additionally, if all message slots are full, a memory full indicator 33 is activated.

Table 1 illustrates the number of messages that can be stored in the paging receiver using particular configurations of memory when the CODEC is operating at a specific bit rate. Even though the table lists specific memories, it is to be understood that numerous other memories can be used in the practice of the present invention. Continuing with the above described table, referring to the 1 megabyte CMOS DRAM, if the paging receiver is configured for two messages and the CODEC is operating at 25 kilobytes per second (KBPS), Table 1 illustrates that 20 seconds of voice information can be stored in one message slot. As is evident from Table 1, the CODEC operates in a plurality of operating rates such as 16 KBPS per second, 25 KBPS per second, and 32 KBPS per second. The operating rates can be selected by jumper connections within the paging receiver or by switches external to the paging receiver.

TABLE 1

Message Length as a Function of Bit Rate and Memory Size

| Number of Messages | 16 KBPS | 25 KBPS | 32 KBPS |
|---|---|---|---|
| | One 256K CMOS DRAM | | |
| 1 | 16 second | 10 second | 8 second |
| 2 | 8 second | 5 second | 4 second |
| | Two 256K CMOS DRAMs | | |
| 1 | 32 second | 20 second | 16 second |
| 2 | 16 second | 10 second | 8 second |
| 4 | 8 second | 5 second | 4 second |
| | One 1 Meg CMOS DRAM | | |
| 1 | 64 second | 40 second | 32 second |
| 2 | 32 second | 20 second | 16 second |
| 4 | 16 second | 10 second | 8 second |

The following flow charts refer to the operation of microprocessor 28. The programs are stored in ROM 30 in a predetermined sequence to cause the operation of the microprocessor 28 for storing, protecting, and reading the messages in accordance with the following flow charts. Other routines for the operation of the paging receiver are included in the ROM, however, the routines are not described herein since they are not needed for the understanding of the invention.

FIGS. 2–5 relate to a method for storing and retrieving messages in a chronological order without regard to the status value of a message. FIGS. 6–9 relate to a method for storing and retrieving messages according to a predetermined priority scheme, depending on status value and order of receipt. For FIGS. 6–9, the status values of the messages illustratively take the form of unread, read, and empty, with unread having the highest priority (thus last to be destroyed). It is understood, however, that other status values may be used and the above used status values are not to be construed as limiting either the scope of the invention or the scope of the disclosure.

Figure 2:
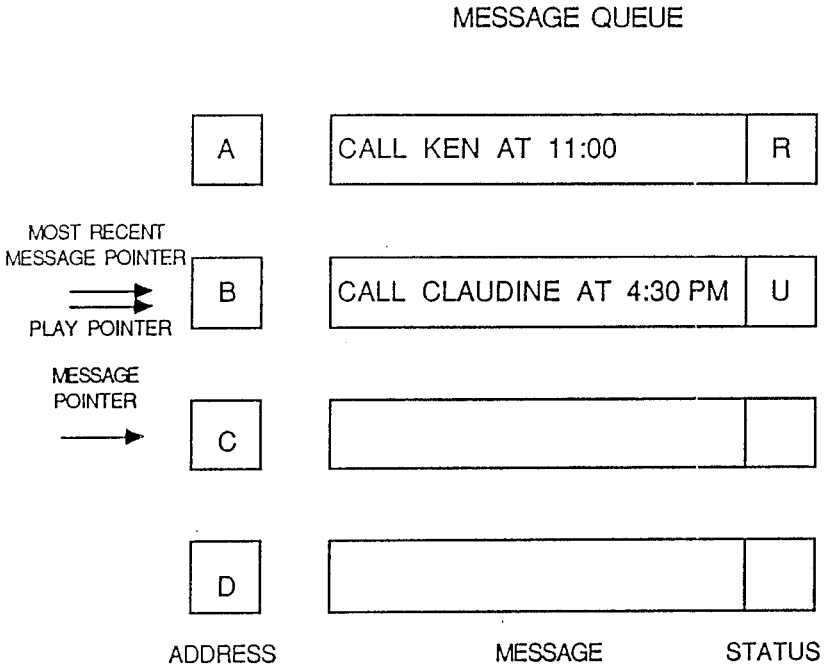
FIG. 2 illustrates a plurality of messages in a message queue.

Referring to FIG. 2, there is shown an illustrated example of the plurality of message slots in the digital stored voice paging receiver of the present invention. For purposes of illustration, four message slots are shown. However, it is to be understood that more than four message slots or as few as two can be used with the paging receiver of the present invention, the number of message slots being limited only by the size of memory.

For clarity, the address of each message slot is labelled A, B, C, and D. Considering the example, then, message slot two (2) is associated with address "B". Also associated with each message slot is an unread/-read tag which indicates whether the message is unread or read. Each message slot is capable of storing a digitized voice message for a time period, depending on the size of memory and number of message slots as explained with reference to Table 1. To illustrate two sample messages, FIG. 2 shows a read digitized voice message "CALL KEN AT 11:00" occupying address "A" and an unread digitized voice message "CALL CLAUDINE AT 4:30 PM" occupying address "B".

To explain the method of chronologically playing back the most recent to the oldest message and the recording over oldest to most recent message, three address pointers (MESSAGE POINTER, MOST RECENT MESSAGE POINTER, and PLAY POINTER) which illustratively point to address A through D of the four message slots example illustrated in FIG. 2 are used. The plurality of message slots are referred to as a message queue with address "A" being the beginning of the queue and address "D" being the end of the queue. Reference will continually be made to FIG. 2 for explaining the flow charts of FIGS. 3–5.

Figure 3:
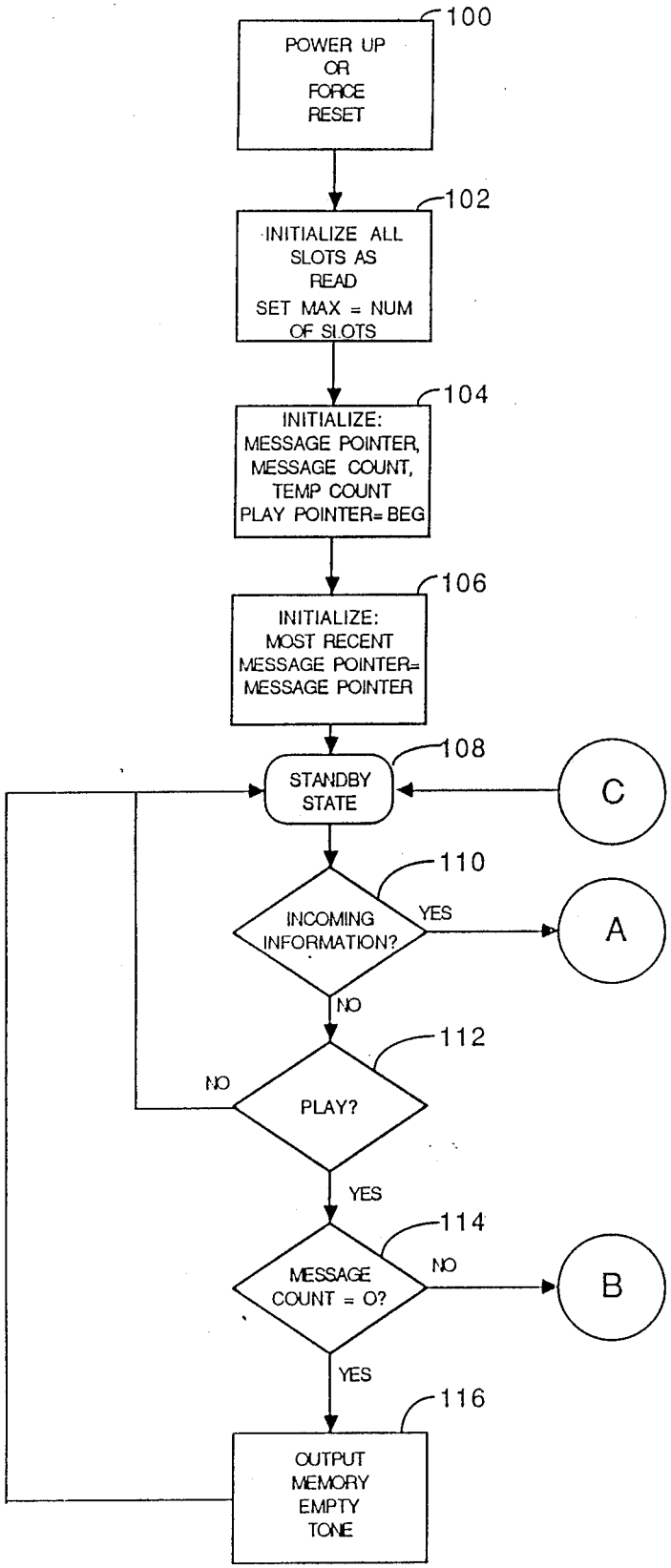
FIG. 3 is a detailed flow chart illustrating a method of the present invention for chronological replacing messages.
Figure 4:
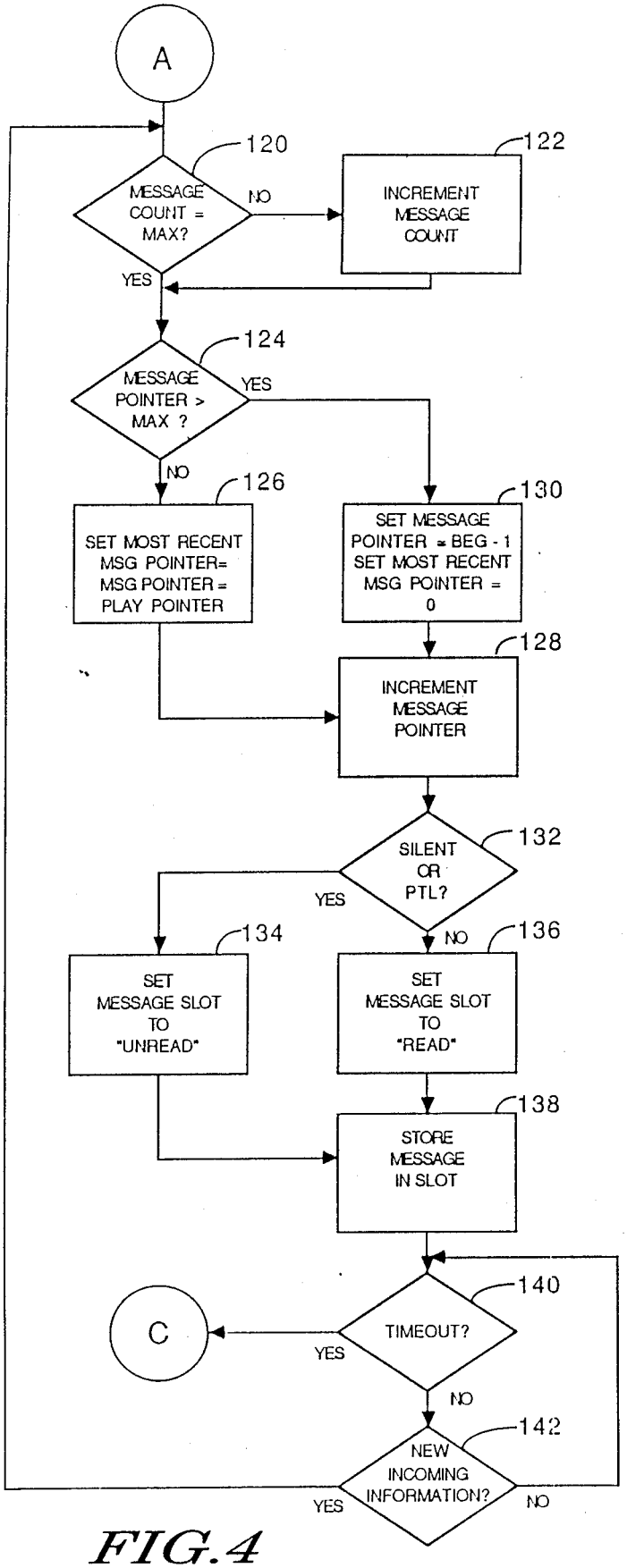
FIG. 4 is a flow chart illustrating the record routine of the method of FIG. 3.
Figure 5:
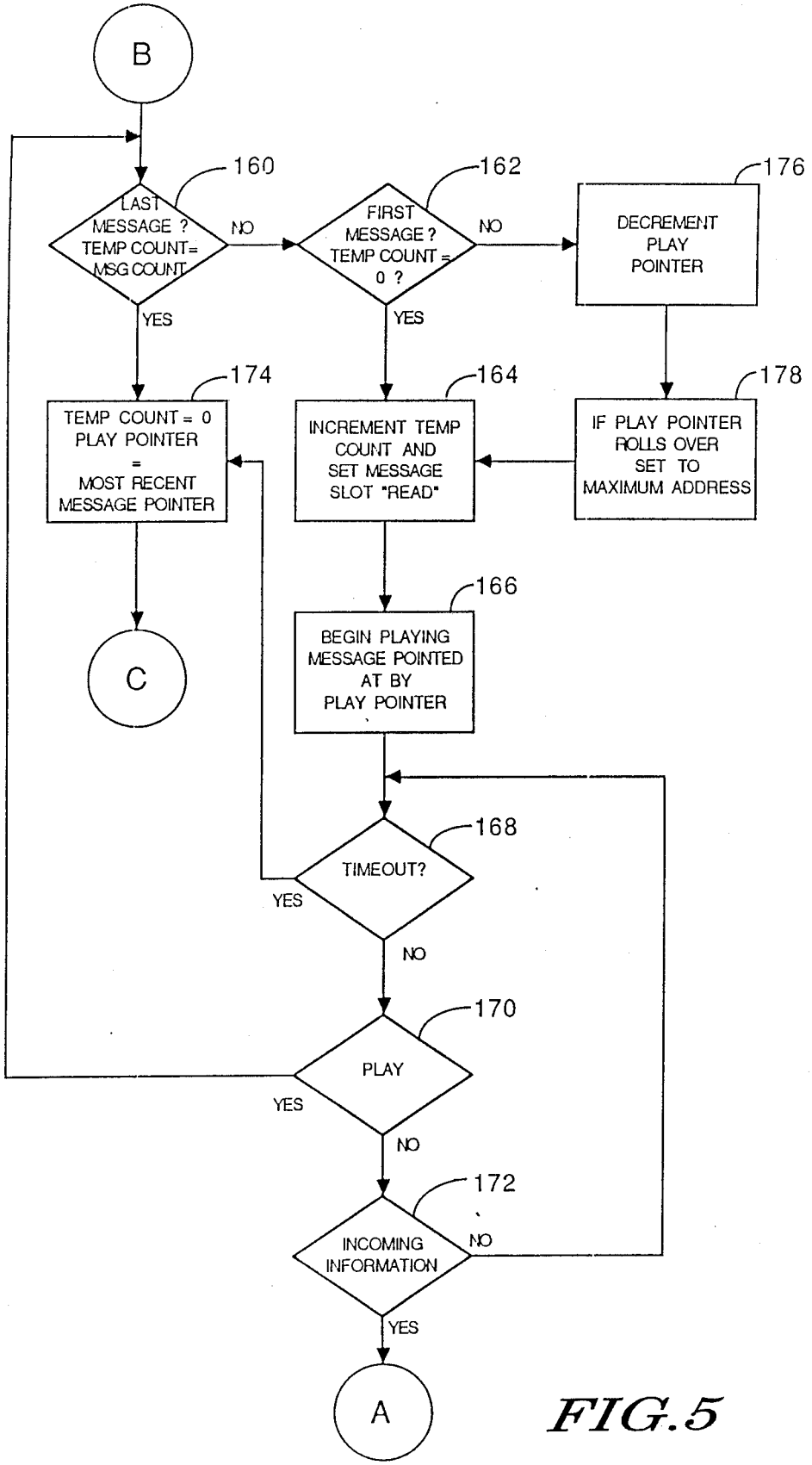
FIG. 5 is a flow chart showing the play routine of the method of FIG. 3.

In general, FIGS. 3–5 describe the method of storing messages in a plurality of message slots and replaying the messages in chronological order. The messages are played in chronological order from the most recently received message to the oldest received message without regard to the status of the message slots (unread versus read). The paging receiver system achieves this capability by storing the messages in the message queue in a forward direction, such as beginning to end, and retrieving the messages from the queue in a reverse direction, such as end to beginning. The position for storing and playing in the queue are controlled by separate pointers. When a boundary of the queue is reached by either pointer, the method sets the pointer to the opposite end of the queue.

For purposes of illustration, the pointers discussed are a MESSAGE POINTER, a MOST RECENT MESSAGE POINTER, and a PLAY POINTER. The MESSAGE POINTER being the storage pointer that points to the next message slot in which a message can be stored. If there are less messages stored than the maximum number of slots in the message queue, the MESSAGE POINTER points to the next empty message slot. If the message queue is full, the MESSAGE POINTER points to the oldest message slot. The PLAY POINTER points to the message slot to be played. The MOST RECENT MESSAGE POINTER points to the most recent message received to give a starting point for the PLAY POINTER.

In the operation of the system, the paging receiver is initially powered up or reset, step 100. A force reset is indicative of the microprocessor being reset by user interaction or a microcontroller when a malfunction occurs. The method begins by initializing all the message slots to the read state. The variable MAX is set to the maximum number of message slots, step 102. Referring to the above described example of FIG. 2, MAX is equal to four. The method then sets the MESSAGE POINTER to point to the beginning address or, in the example of FIG. 2, address "A". A message count being a count of the number of messages received is initially set to zero, step 104. The MOST RECENT MESSAGE POINTER which points to the address of the most recent message is initialized to the beginning address such as address "A", step 106. The paging receiver then goes into the standby state 108, waiting for incoming information or activation of the play switch.

If incoming information is detected, the system is directed to the record routine. In the record routine, the system stores the digitized voice message in the message slot pointed to by the MESSAGE POINTER. Reference is made to FIG. 4 for a more detailed discussion for recording the message. If incoming information is not detected, eventually the play switch may be activated, step 112. If the play switch is activated, it is determined whether the message count is equal to zero, step 114. If the message count is equal to zero, the play switch has been activated with no messages being received and the system outputs a memory empty tone, step 116. The method then loops back to the standby state 108 to wait for incoming information or for activation of the play switch. Referring back to step 114, if the message count is not equal to zero, this implies a message has been received by the system and stored in the message queue. The system is then vectored to the play routine as described in FIG. 5 to play back the message.

Referring to FIG. 4, there is shown a method for storing messages received by incoming information. The method begins by determining if the message count is equal to the maximum number of message slots. That is, have all the message slots been filled. Initially, the message count is set to zero and if the message count is less than the maximum number, this implies an empty message slot is available. If the message count is less than the maximum number of message slots, the message count is incremented by one, step 122.

Referring back to step 120, if the message count is equal to the MAX, then the message count is not incremented. Thus, when the message count reaches MAX, this indicates that a message is contained in every slot. Therefore, upon play back, the system recognizes that each message slot includes a message to be played back. It is then determined whether the MESSAGE POINTER is greater than the maximum address, step 124. If the MESSAGE POINTER is not greater than the maximum address, this implies that a MESSAGE POINTER queue rollover has not occurred. A queue rollover is when a POINTER reaches the beginning or end of the message queue and is then set to the bottom or top of the queue, respectively. If a MESSAGE POINTER queue rollover has not occurred, the MESSAGE POINTER is less than or equal to the maximum address and the MOST RECENT MESSAGE POINTER is set to the address of the next message slot available pointed to by the MESSAGE POINTER, step 126. Also at this time, the PLAY POINTER is set to the MOST RECENT MESSAGE POINTER to permit the playing back of messages from the most recent message. If the MESSAGE POINTER is greater than the maximum address, then a MESSAGE POINTER queue rollover has occurred and the MOST RECENT MESSAGE POINTER is set to the beginning address, step 130. Additionally, the MOST RECENT MESSAGE POINTER is initialized to the beginning address. The MESSAGE POINTER is then incremented to point to the next available message slot, step 128.

Referring to our simplified example of FIG. 2, two messages are shown to be recorded in addresses "A" and "B". We note that the MESSAGE POINTER points to address "C" which is the next available message slot. When new information is received, the MOST RECENT MESSAGE POINTER is set equal to the MESSAGE POINTER such as address "C", step 126. The MESSAGE POINTER is then incremented to the next available address, step 128. If the MESSAGE POINTER is pointing to "E" at step 124, then the MOST RECENT MESSAGE POINTER and MESSAGE POINTER are set to address "A".

To recapitulate, at a queue rollover, the MESSAGE POINTER is set back to point back to address "A". Referring back to step 124, this is accomplished by determining if the MESSAGE POINTER is greater than or equal to the maximum address. Thus, if the MESSAGE POINTER has been incremented beyond address "D", the MESSAGE POINTER is then set to point to the beginning address such as address "A". This is accomplished by setting the MESSAGE POINTER to the beginning address and setting the MOST RECENT MESSAGE POINTER to the beginning address, step 130. The MESSAGE POINTER is then incremented to the next available message slot which would be "B", step 128.

Continuing with the discussion of the record routine, if the paging receiver is in the silent mode or PTL mode, then the message is tagged to the "unread" state, steps 132–134. Referring back to step 132, if the paging receiver is in the normal mode, then the message is tagged to the "read" state, step 136. The message is then recorded into the slot pointed to by the MOST RECENT MESSAGE POINTER.

Thus, in our example of FIG. 2, the new message is stored in address "C" which is pointed to by the MOST RECENT MESSAGE POINTER. The system then continues to store the incoming information until the amount of memory available for the slot is reached, step 140, the timeout depending upon the amount of memory and bit rate of the CODEC as illustrated in Table 1. If the timeout is not reached, recording continues and it is determined whether there is new incoming information, step 142. If new information is detected before the present message is completely stored, the system stops recording and repeats steps 120–140 to record the new incoming information in the next available message slot. Eventually, the timeout for recording message is reached and the system returns to the standby state 108.

To briefly summarize, the record routine stores the messages in a first direction, such as beginning to ending, in the message queues. The record routine first determines the next available message slot and then stores the message in that slot. Since there are a limited number of message slots, when the upper limit of the message queue is reached, the method rolls the pointers back to the beginning of the message queue to begin storage at the beginning of the message queue. In addition to restarting at the beginning of the message queue, upon receiving incoming information, the record routine determines if the system is in the silent, PTL or normal mode. If in the PTL or silent mode, the message slot is tagged "unread". If the system is in the normal mode, the message is tagged "read".

Referring briefly back to FIG. 3, if the play switch is activated and the message count is greater than zero, then the method proceeds to the play routine as illustrated in FIG. 5. In the play routine, the messages are retrieved from the message queue in a second direction opposite the first direction of the record routine. The method begins by determining if this is the last message, step 160. The last message is determined by deciding if a temp count variable is equal to the message count. If the system has reached step 160 from the standby state 108, the temp count variable is zero. If the temp count variable is zero, the message count will be greater than zero, and the system is vectored to step 162. It is then determined whether this is the first message, step 162. The first message is determined by analyzing the temp count variable. If the temp count variable equals zero, then this is the first message and the method proceeds to step 164. If the temp count variable is not equal to zero, this indicates that the play switch has been activated during the playback of the previous message and the user desires to hear the next message.

Referring back to step 164, if the temp count variable is zero, this is the first message and the temp count variable is incremented by one. Additionally, the message slot is tagged to "read". The message is then played from the position pointed at by the PLAY POINTER, step 166. Note the PLAY POINTER is set to the most recent address in the record routine and that address is played back.

The method then determines if the message has been played for the timeout period, step 168. If a timeout has not occurred, then it is determined whether the play switch has been activated during the playing back of the message, step 170. If it has not, then incoming information is checked, step 172. If no incoming information is present, then the system loops back to determine if a timeout has occurred, step 168. Thus, the system will play back the message until a timeout or forced timeout (such as reset switch) occurred, the play switch is activated, or incoming information is detected. If the play switch is not activated, nor incoming information detected, the message will eventually play in its entirety. The system then sets the temp count variable to zero and sets the PLAY POINTER equal to the MOST RECENT MESSAGE POINTER, step 174. The system then returns to the standby state 108.

If the user desires to play back more than the first message, the play switch is activated during the playing of the present message, step 170. In this case, the method is vectored back to step 160. In this instance, it is determined whether this is the last message. If it is the last message, the temp count variable is set equal to zero and the PLAY POINTER is set to the MOST RECENT MESSAGE POINTER, step 174. If this is not the last message, then the system determines if this is the first message of the queue, step 162. Since the temp count variable has now been incremented and this is not the first message in the queue, the PLAY POINTER is decremented, step 176. Note that decrementing the PLAY POINTER sets the pointer in the opposite direction of the MESSAGE POINTER. This insures that the next most recent message is played back.

Referring to our simplified example of FIG. 2, if the first message at address "B" is being played, and the play switch is activated during the playing back of the message at address "B", the PLAY POINTER which has been pointing to address "B" is now decremented to address "A" and the next most recent message is played back. If the PLAY POINTER reaches the beginning of the message queue, the PLAY POINTER is set to the end of the message queue, step 178. Referring back to FIG. 2, if the next message to play back is in address "D", the play switch is set to address "D". The temp count variable is then incremented, the message slot set to "read", and the message is played back from the position pointed to by the PLAY POINTER, step 166.

Thus, the play message routine plays messages back in a chronological order from the most recent to the oldest. This is accomplished by decrementing the PLAY POINTER which is set during the record routine to equal the MOST RECENT MESSAGE POINTER when the recording is done by incrementing the MESSAGE POINTER. Referring to FIG. 2, if the PLAY POINTER reaches the beginning of the queue, such as address "A", the PLAY POINTER is set to the end of the message queue or address "D", thus playing the messages back in a chronological order. The requirement for playing back the next most recent message is that the play switch must be activated before the timeout of the playing of the current message occurs. For example, if the third oldest message is played back, the play switch must be activated consecutively three times within a timeout period. It should be noted that when each message is played back, the timeout period is reset.

Figure 6:
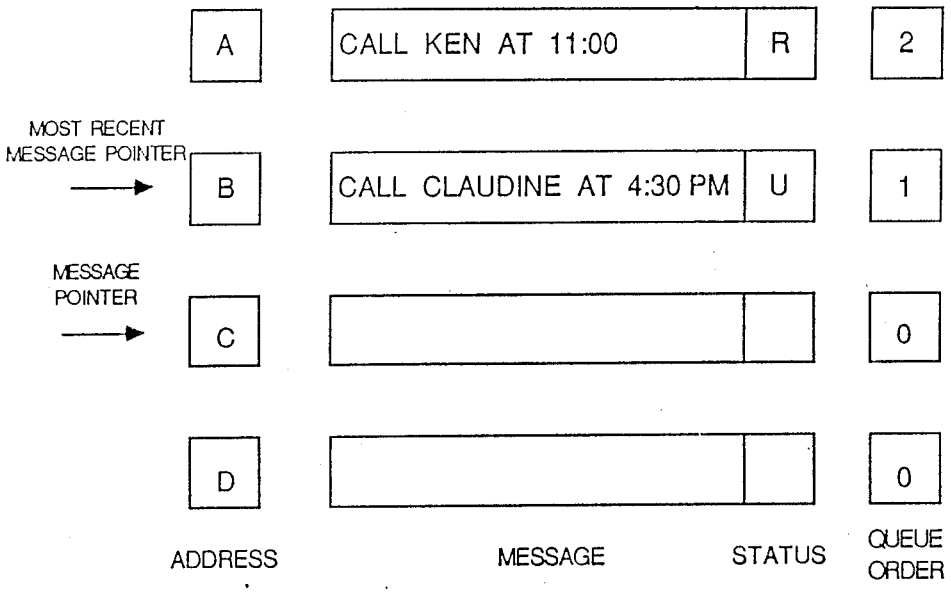
FIG. 6 illustrates a plurality of messages in a message queue useful in explaining a method for protecting messages according to a priority scheme.

Referring to FIG. 6, there is shown an illustrated example of the plurality of message slots in the digital stored voice paging receiver of a method for prioritizing the messages between "read" and "unread" status. For purposes of illustration, four message slots are shown. However, it is to be understood that more than four message slots can be used with the present invention, the number of message slots being limited only by the size of memory and bit rate of the CODEC. For illustrative purposes, the address of each message slot is labelled A, B, C, and D. Considering the example, then, message slot two (2) is associated with address B. Also associated with each slot is an unread/read status tag which indicates whether the message is unread or read. Also associated with these message slots is a queue order variable. The queue order is representative of the order when the message was received when compared to the other messages. For example, if a message has a queue order of 4, this signifies that this is the oldest message, while a queue order of 1 signifies that this is the youngest message. Each message slot is capable of storing a digitized voice message for a timeout period, depending upon size of memory and number of message slots, as previously explained with reference to Table 1.

To illustrate a method of prioritizing between read and unread messages by protecting unread messages over read messages, the discussion which follows uses address pointers (MESSAGE POINTER and MOST MESSAGE RECENT MESSAGE POINTER) which illustratively point to addresses A through D of the four message slot example illustrated in FIG. 6. The plurality of message slots is referred to as a queue with the address A being the beginning of the queue and address D being the ending of the queue. Reference will continually be made to FIG. 6 for explaining the flow chart of FIGS. 7–9.

Figure 7:
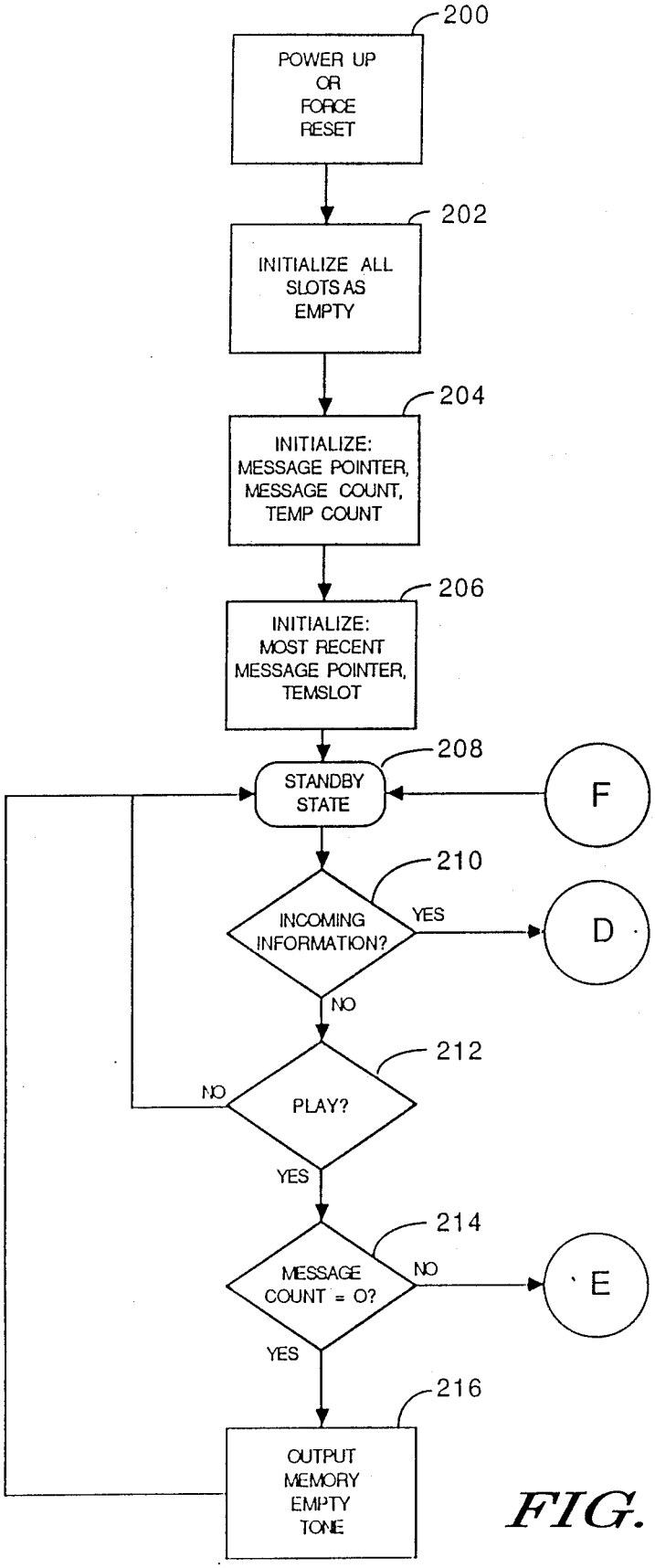
FIG. 7 is a flow chart for storing messages according to a predetermined priority scheme.
Figure 8:
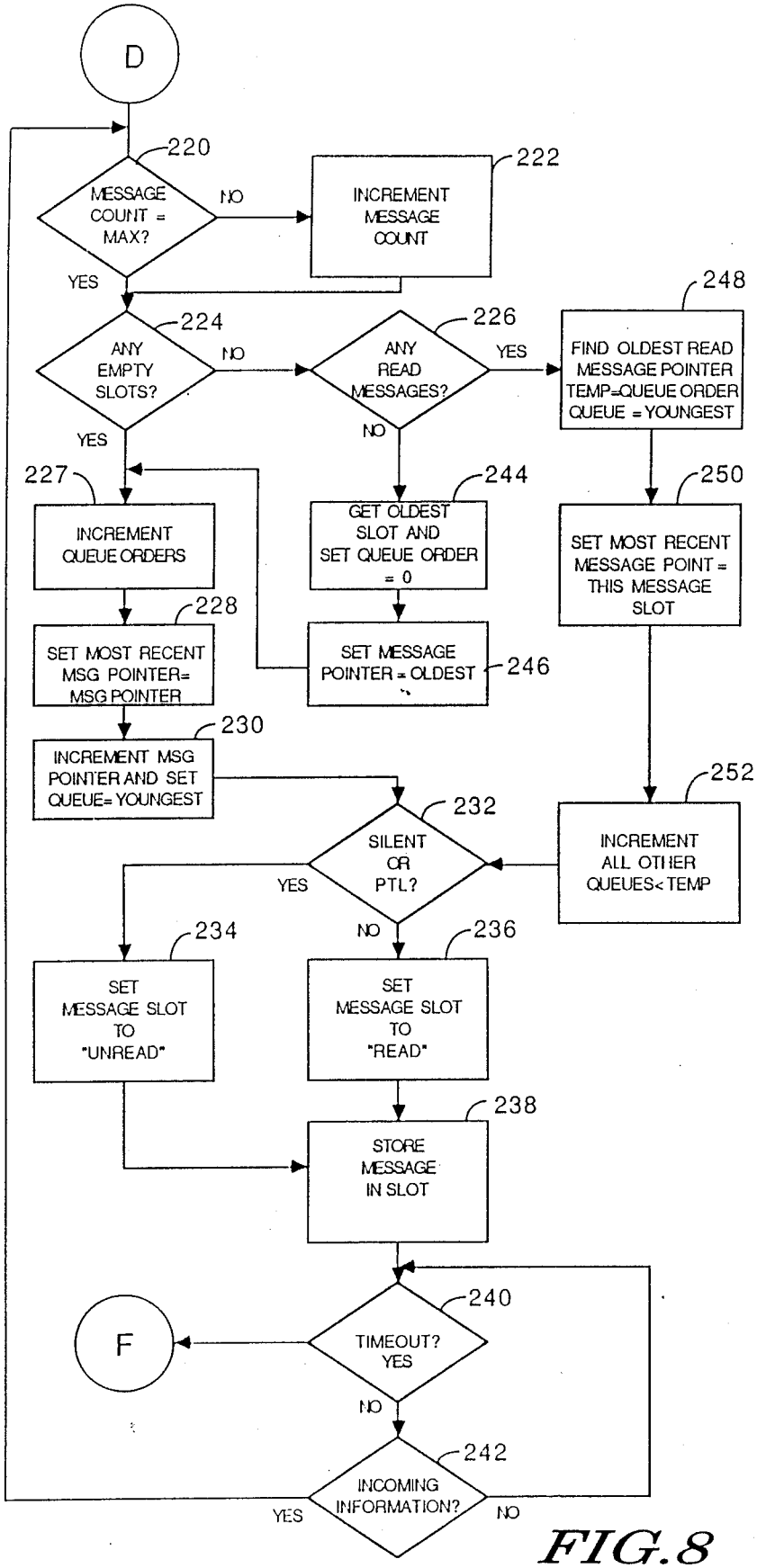
FIG. 8 is a flow chart of the method of FIG. 7 for storing the new digitized voice message to a memory position according to a predetermined priority scheme.
Figure 9:
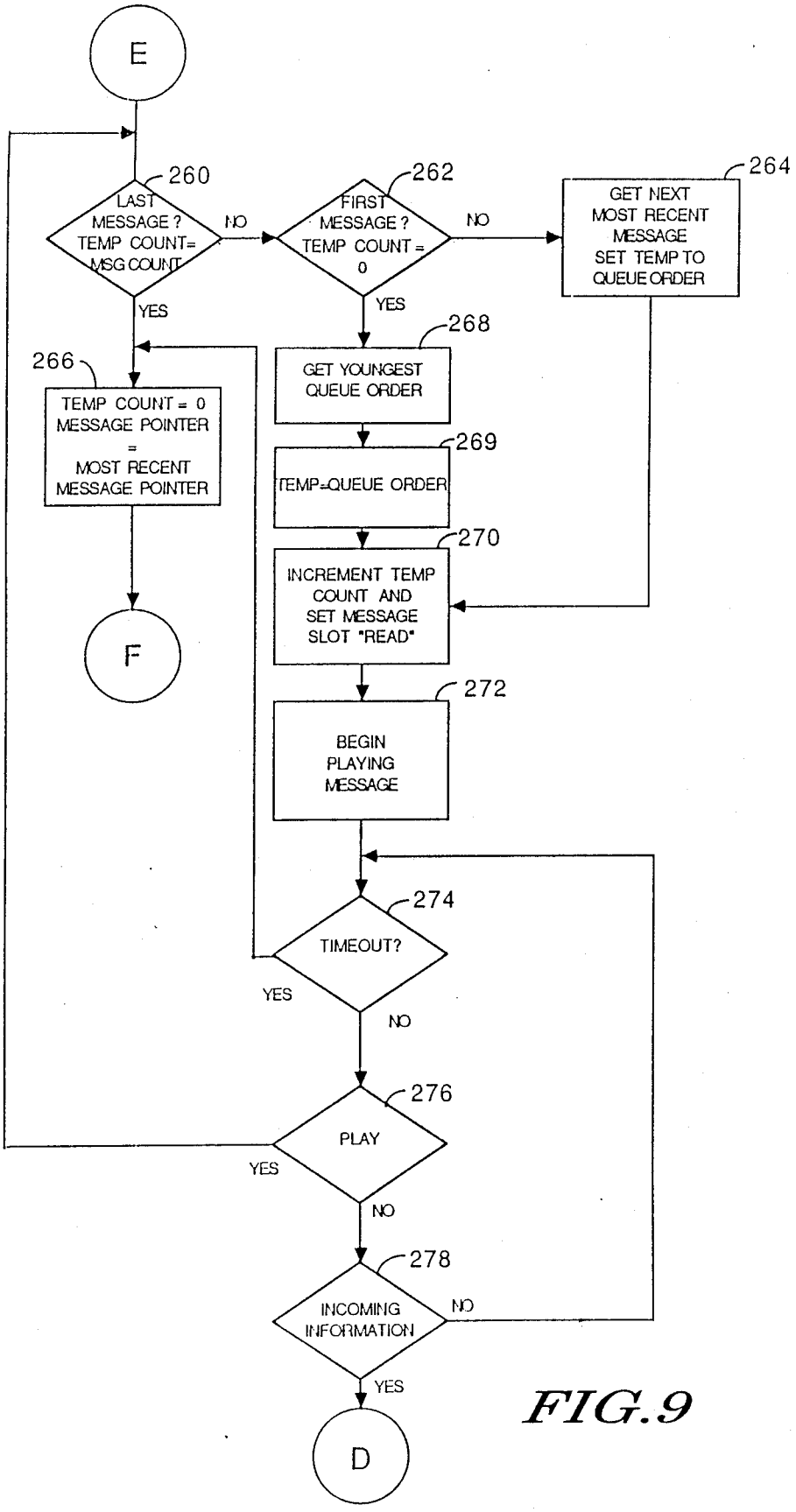
FIG. 9 illustrates the play routine for the method of FIG. 7.

In general, FIGS. 7–9 describe a method for storing messages in a plurality of message slots, the messages stored according to a priority scheme in which the priority scheme replaces read messages before unread messages. Upon play back, the messages are played in chronological order, whether they are read or unread, from the most recent received message to the oldest received message. For purposes of illustration, the method uses the MESSAGE POINTER and a MOST RECENT MESSAGE POINTER as previously defined. The MESSAGE POINTER points to the next "read" message slot in which a message can be stored. The MOST RECENT MESSAGE POINTER points to the youngest message in the message queue.

In general, the system stores messages only in empty slots. When empty slots become unavailable, the system stores a message only in "read" slots, leaving unread messages protected. In playback, the system scans the queue order and retrieves the messages according to the queue from youngest to oldest.

In the operation of the system, the paging receiver is initially powered up or reset, step 200. A forced reset is indicative of the microprocessor being reset by user interaction or a microcontroller because of a malfunction condition. The method begins by initializing all the message slots to the empty status. This enables all the message slots to be overwritten by incoming messages. The variable MAX is set to the maximum number of message slots. Referring to the above described example of FIG. 6, MAX is set equal to four. The message then sets the MESSAGE POINTER to the beginning address of the message queue. The MOST RECENT MESSAGE POINTER is also initialized to point to the beginning address, such as address A. A message count being a count of the number of messages received is initially set to zero, step 204. The paging receiver then goes into the standby state, 208, awaiting for incoming information or activation of the play switch.

If incoming information is detected, the system is directed to the record routine. In the record routine, the system protects unread messages by allowing only read message to be overwritten by incoming information. For a detailed discussion of the record routine, attention is directed to FIG. 8. If incoming information is not detected, eventually the play switch may be activated, step 212. If the play switch is activated, it is determined whether the message count is equal to zero, step 214. If the message count is equal to zero, the play switch has been activated with no messages being received and the system outputs a memory empty tone, step 216. The method then returns to the standby state 208 to wait for incoming information or for activation of the play switch. Referring to step 214, if the message count is not equal to zero, a message has been received by the system and is stored in the message queue. The system is then vectored to a play routine to play the message as disclosed in FIG. 9.

Referring to FIG. 8, there is shown a method for storing messages received by incoming information according to a prioritization scheme. The prioritization scheme protects unread messages while permitting destruction of read or empty message slots. The method begins by determining if the message count is equal to the maximum number of message slots, step 220. This determines if there are any empty message slots available. If there are empty message slots available, the message count is incremented, step 222. Again, it is determined whether there are any empty message slots available, step 224. In this case, the queue order of all stored messages are incremented, step 227. This step effectively ages all the stored messages by increasing the queue order of all stored messages. The MOST RECENT MESSAGE POINTER is then set to the next message slot available pointed to by the MESSAGE POINTER, step 228. The MESSAGE POINTER is then incremented to the next message slot available and the queue order for that slot set to the youngest, step 230.

It is then determined whether the system is operating in either the silent or PTL mode, step 232. If the system is operating in the silent or PTL mode, then the message is tagged "unread", step 234. If the system is operating in the normal mode, then the message slot is tagged "read", step 236. The message is then stored into the slot pointed to by the MOST RECENT MESSAGE POINTER, step 238. The system then continues to record the incoming information until the amount of memory available for the slot is reached, step 240. If the timeout for the slot is not reached, recording continues and it is determined whether new incoming information is available, step 242. If new information is detected before the present message is stored, the system stops recording the present message and repeats steps 220 through 240 to record the new incoming information in the next available message slot. Eventually, the timeout for recording messages is reached, and the system returns to the standby state 208.

Referring back to step 224, if there are no empty message slots available, this indicates that a message queue rollover has occurred. If a message queue rollover has occurred, this indicates that previously stored message information must be destroyed to accommodate the new incoming information. The method then determines if any read messages are available, step 226. If no read messages are available, then the system will store the incoming information in the oldest message slot available even if the slot is unread. This is determined by scanning the queue order and retrieving the address of the message slot with the highest queue order value, the highest queue order value being the oldest message. The queue order for this slot is then set to zero, step 244. The MESSAGE POINTER is then set to the oldest message slot, step 246. The system then ages all the queue order values, sets the MOST RECENT MESSAGE POINTER to the MESSAGE POINTER, steps 226–230. Continuing, the method determines if the paging receiver is in a silent or PTL mode, sets the message slot to read or unread and stores the message in the appropriate slot, steps 232–242.

Referring back to step 226, if any read messages are available, the read messages are destroyed to protect the unread messages. The method determines the oldest read message available by scanning the message slots, finding the read messages and determining the read message with the oldest queue order value, step 248. A temporary variable is set equal to the oldest read message queue order value and the queue order value of that slot is then set equal to one representing the youngest message, step 250. The MOST RECENT MESSAGE POINTER is then set to the MESSAGE POINTER of the slot, step 252. The method then increments all the other queue orders which are less than the queue order stored in the temporary variable from the oldest read message slot. This effectively ages all the message slots that have a queue order less than the found oldest read message slot. This preserves the chronological order of the messages remaining. The method then proceeds to determine if the paging receiver is set to the silent or PTL mode as previously described before.

To recapitulate, in general, the record routine records incoming information into empty message slots first and then into read messages if no empty message slots are available and then into unread message slots if no empty or read message slots are available. The message slots are replaced in chronological order from the oldest to the youngest. Thus, the method preserves unread messages at the cost of read messages and preserves chronological order for the paging receiver user.

Referring briefly back to FIG. 7, if the play switch is activated and the message counter is greater than zero, then the method proceeds to the play routine as illustrated in FIG. 9. In the play routine, the method begins by determining if this is the last message, step 260. The last message is determined by deciding if the temp count variable is equal to the message count. If the system has reached step 260 from the standby state 208, the temp count variable is zero. If the temp count variable is zero, the message count will be greater than zero, and the system then determines if this is the first message in the queue, step 262. The first message of the queue is determined by analyzing the temp count variable. If the temp count variable equals zero, then this is the first message and the method proceeds to determine the most recent message to play back by analyzing the queue order variable. The method retrieves the queue order variable for the messages and determines the youngest queue order variable, step 268. The youngest queue order variable is then stored in a temporary position to be used later when searching for the next most recent message, step 269. The method then increments the temp count variable and sets the message slot to the read status, step 270. The method then begins playing the message from the youngest queue order variable found, step 272. The method then determines if the message has played according to the timeout for the message, step 274. If the message is not played back for the length of time recorded, a timeout has not occurred. It is then determined whether the play switch has been activated during the playing back of the message, step 276. If it has not, then incoming information is checked, step 278. If no incoming information is present, then the system loops back to determine if a timeout has occurred, step 274. Thus, the system will play back the message until a timeout or forced timeout via the reset switch occurs, the play switch is activated, or incoming information is detected. If the play switch is not activated nor incoming information is detected, the message will eventually play in its entirety. The system then sets the temporary counter to zero and sets the message pointer equal to the MOST RECENT MESSAGE POINTER, step 266. The system then returns to the standby state 208.

If it is desired to play back more than the first message, the play switch must be activated during the playing of a message, step 276. In this case, the method is vectored back to step 260. In this instance, it is determined whether this is the last message. If it is the last message, the temp counter is set equal to zero and the MESSAGE POINTER equal to the MOST RECENT MESSAGE POINTER, step 266. If this is not the last message, then the system determines if this is the first message, step 262. Since the temp count variable has now been incremented and this is not the first message, the system retrieves the next most recent, step 264. This is accomplished by incrementing the temporary queue order variable stored in step 269 and scanning the messages to retrieve the message corresponding to this variable. The MESSAGE POINTER is then pointed to the message with the next highest queue order variable and the method proceeds again by incrementing the temp count variable and setting the message slot equal to "read", step 270.

Thus, the play routine plays messages back in a chronological order by scanning the queue order variable. The messages are played back from the most recent to the oldest. This is accomplished by scanning the queue order variable to determine the youngest and oldest message.

Thus, there has been shown two methods for prioritizing messages in a digital stored voice paging receiver. In the first method, messages are stored and retrieved in a chronological order. In the second method, messages are stored and retrieved according to a predetermined priority, depending upon a status value associated with each stored message and the order messages are received. It is to be understood that other status values other than unread, read, and empty may be used. For instance, messages may be designated protect, unread, read, and empty with protect being the highest priority and empty being the lowest.

It should be apparent from the above description that numerous variations can be made from the preferred embodiment described herein without departing from the scope of the invention. Accordingly, this invention is not to be regarded as limited to the embodiment disclosed therein but is to be limited as defined by the appended claims.

What is claimed is:

1. A method of storing in a fixed memory area of a paging receiver analog voice messages transmitted thereto from a remote source, said fixed memory area including a fixed number of storage slots with each slot capable of storing only one digitized voice message, said method comprising the steps of:

(a) receiving and digitizing a transmitted analog voice message to recover a new digitized voice message replica thereof;

(b) setting said paging receiver in one of a first mode to audibilize said transmitted analog voice message upon receipt or a second mode to not audibilize said transmitted analog voice message upon receipt;

(c) initially assigning said new digitized voice message replica a priority status based on said mode setting corresponding thereto;

(d) thereafter, storing said new digitized voice message replica and its assigned priority status in an empty storage slot of said fixed memory area, and if there are no empty storage slots of said fixed memory area, storing said new digitized voice message replica and its assigned priority status in a selected storage slot based on a predetermined priority relationship between the currently stored voice message of said selected storage slot and the other currently stored voice messages of said fixed memory area, thereby replacing said currently stored voice message of the selected storage slot with said new voice message.

2. A method in accordance with claim 1 including the steps of:

assigning a storage status to each voice message being stored in the storage slots of the fixed memory area in accordance with the storage chronology thereof, said storage status ranging from the oldest to the newest; and storing the new digitized voice message replica in the selected storage slot based solely on the storage status of the currently stored voice message thereof when said fixed memory area is filled with currently stored voice messages.

3. A method in accordance with claim 2 wherein the new digitized voice message replica is stored in the selected storage slot having a currently stored message with the storage status of the oldest.

4. A method in accordance with claim 1 including the steps of:

assigning a storage status to each voice message being stored in the storage slots of the fixed memory area in accordance with the storage chronology thereof, said storage status ranging from the oldest to the newest; and storing the new digitized voice message replica in the selected storage slot based on both of the priority status and storage status of the currently stored voice message thereof.

5. A method in accordance with claim 4 wherein the initially assigning step includes assigning a read priority status corresponding to the first mode and an unread priority status corresponding to the second mode.

6. A method in accordance with claim 5 including the step of reassigning the unread priority status of a currently stored voice message to a read priority status when said voice message is first audibilized by the paging receiver.

7. A method in accordance with claim 6 wherein the new digitized voice message replica is stored in the selected storage slot having a currently stored voice message which is the oldest stored, unread voice message of the fixed memory area.

* * * * *